US008371084B2

(12) United States Patent
Babineau, Jr.

(10) Patent No.: US 8,371,084 B2
(45) Date of Patent: Feb. 12, 2013

(54) SUSPENDED CEILING STRUCTURE AND LAYER-CORE-LAYER ACOUSTIC CEILING PANEL THEREFOR

(75) Inventor: Francis John Babineau, Jr., Parker, CO (US)

(73) Assignee: Johns Manville, Denver, CO (US)

( * ) Notice: Subject to any disclaimer, the term of this patent is extended or adjusted under 35 U.S.C. 154(b) by 1159 days.

(21) Appl. No.: 11/788,188

(22) Filed: Apr. 19, 2007

(65) Prior Publication Data

US 2008/0256879 A1 Oct. 23, 2008

(51) Int. Cl.

| | |
|---|---|
| ***E04B 1/82*** | (2006.01) |
| ***E04B 2/02*** | (2006.01) |
| ***E04B 2/00*** | (2006.01) |
| ***E04B 5/00*** | (2006.01) |
| ***E04B 9/00*** | (2006.01) |
| ***B32B 5/26*** | (2006.01) |
| ***B32B 27/12*** | (2006.01) |
| ***B32B 1/00*** | (2006.01) |
| ***B32B 3/00*** | (2006.01) |
| ***B32B 3/28*** | (2006.01) |
| ***D03D 3/08*** | (2006.01) |

(52) U.S. Cl. ..... 52/506.06; 52/145; 52/144; 181/290; 181/286; 442/381; 442/394; 428/176; 428/181

(58) Field of Classification Search ..... 52/144, 52/145, 506.06; 181/284, 290, 291, 286, 181/288; 442/327, 394; 428/98, 119
See application file for complete search history.

(56) References Cited

U.S. PATENT DOCUMENTS

| | | | | |
|---|---|---|---|---|
| 2004/0076786 | A1 * | 4/2004 | Naipawer, III et al. | 428/40.3 |
| 2004/0180177 | A1 * | 9/2004 | Ray et al. | 428/86 |
| 2004/0219853 | A1 * | 11/2004 | Weir et al. | 442/327 |
| 2004/0231914 | A1 * | 11/2004 | Thompson, Jr. et al. | 181/284 |
| 2005/0211500 | A1 * | 9/2005 | Wendt et al. | 181/295 |

* cited by examiner

*Primary Examiner* — Darnell Jayne
(74) *Attorney, Agent, or Firm* — Robert D. Touslee

(57) ABSTRACT

An acoustic ceiling panel for a lay-in or suspended ceiling includes a core portion, and front and rear layers covering front and rear sides, respectively, of the core portion. The air flow resistance of the core portion does not exceed about 100 MKS rayls. The air flow resistance of the front layer lies in the range of about 300 to about 800 MKS rayls. The air flow resistance of the rear layer lies in the range of about 300 to about 1200 MKS rayls. The panel would be supported on a grid suspended below a structural ceiling to form an air space therebetween.

13 Claims, 2 Drawing Sheets

SUSPENDED CEILING STRUCTURE AND LAYER-CORE-LAYER ACOUSTIC CEILING PANEL THEREFOR

BACKGROUND

This relates to a lay-in or suspended ceiling structure and to acoustic ceiling panels incorporated in the ceiling structure, the ceiling panels being of the type comprising a core having front and rear layers on its respective front and rear sides.

Lay-in ceiling structures typically comprise a system of panels installed on a metal grid. The grid is positioned to create a plenum, or air space, between the rear side of the panels and a fixed structural ceiling thereabove.

It has been heretofore proposed to provide ceiling panels with desirable acoustic characteristics by applying, to the front and rear sides of a core (or substrate), layers in the form of coatings and/or coverings of material (sometimes called skins) having sound-absorbing properties. Acoustic characteristics of such layer-core layer panels are typically determined by measuring the panel's overall resistance to airflow therethrough in the thickness direction of the panel.

The term "panel" as hereafter used, should be considered to mean a layer-core-layer type panel. As used herein, the expression lay-in or suspended ceiling structure means one in which a plenum or air space is formed between the acoustic panels and the rigid structural ceiling (typically about sixteen inches in height).

It has been generally considered that nearly optimum acoustic absorption (i.e., noise reduction coefficient (NRC) of at least 1.0) can be achieved if the panel is designed such that the overall airflow resistance of the panel in the thickness direction (height) of the panel is in the range of 1000-2000 MKS rayls.

However, room for improvement remains and it would be desirable to provide ways of optimizing preferably the class of ceiling panels comprising front and rear sides and a core, and in which the core does not provide the bulk of the airflow resistance for the entire panel.

SUMMARY

Disclosed herein is an acoustic ceiling panel for a lay-in ceiling structure, which panel comprises a core portion having front and rear sides, and front and rear layers on the front end rear sides, respectively. The air flow resistance of the core region is not greater than about 100 MKS rayls, the air flow resistance of the front layer is in the range of about 300 to about 800 rayls (more preferably—about 350 to about 750 MKS rayls), and the air flow resistance of the rear layer is in the range of about 300 to about 1200 MKS rayls (more preferably—about 400 to about 1000 MKS rayls).

BRIEF DESCRIPTION OF DRAWINGS

Depicted in the appended drawings is a detailed description of a preferred embodiment wherein like numerals designate like elements

DETAILED DESCRIPTION OF A PREFERRED EMBODIMENT

The present inventor has discovered that in the case of a layer-core-layer type of acoustic ceiling panel, the optimum acoustic characteristics i.e., a noise reduction coefficient (NRC) of at least 1.0, are not necessarily controlled by the overall air flow resistance of the panel as has been heretofore suggested, but rather by a particular combination of air flow resistances of various regions of the panel, i.e., the front layer, the rear layer and the core.

The term "panel" as hereafter used, should be considered to mean a layer-core-layer type panel. As used herein, the expression lay-in or suspended ceiling structure means one in which a plenum or air space is formed between the acoustic panels and the rigid structural ceiling (typically about sixteen inches in height).

The air flow resistance values described herein are determined by the ASTMC522-03 test method.

Figure 1:
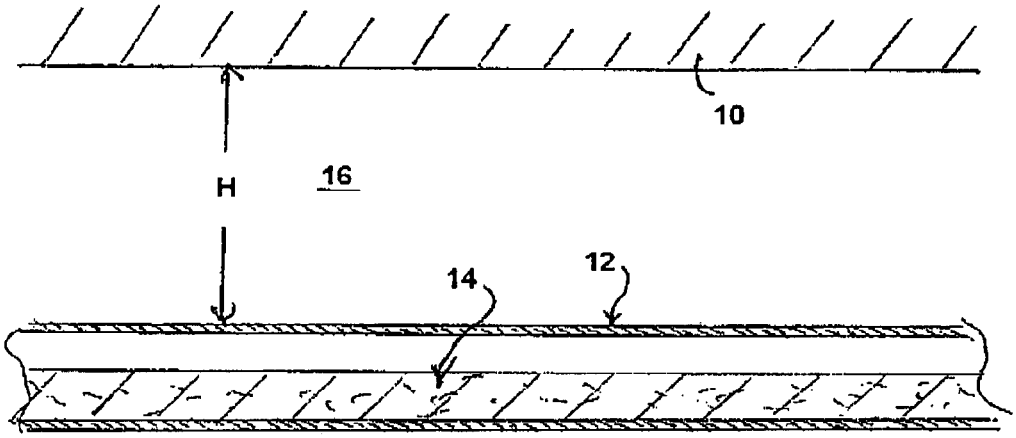
FIG. 1 depicts schematically a vertical sectional view through a ceiling structure having acoustic panels in accordance with the present disclosure.

Depicted in FIG. 1 is a ceiling structure comprising a rigid structural ceiling 10, a grid 12 suspended at a distance below the structural ceiling, and a plurality of acoustic ceiling panels 14 supported on the grid. An air space or plenum 16 is disposed between the structural ceiling and the rear sides of the panels having a height H which is traditionally about sixteen inches. The expression "structural ceiling" as used herein is intended to include roof decks.

Figure 3:
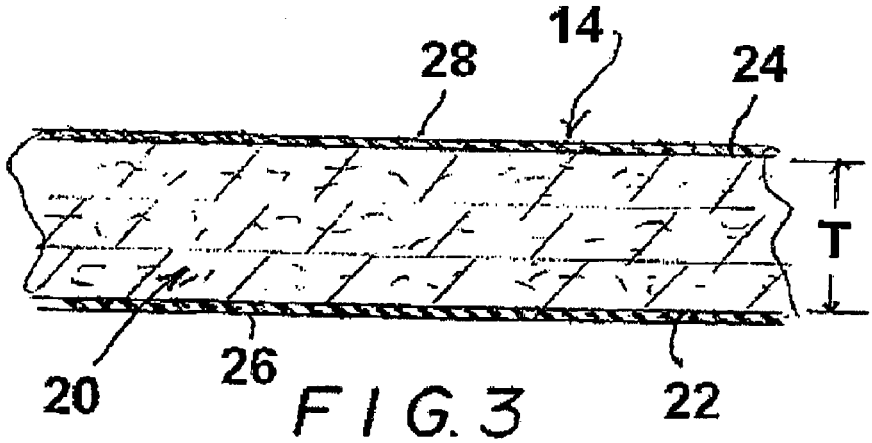
FIG. 3 PRIOR ART
FIG. 3 is a cross-sectional view through an embodiment of a ceiling panel described in detail below.
Figure 2:
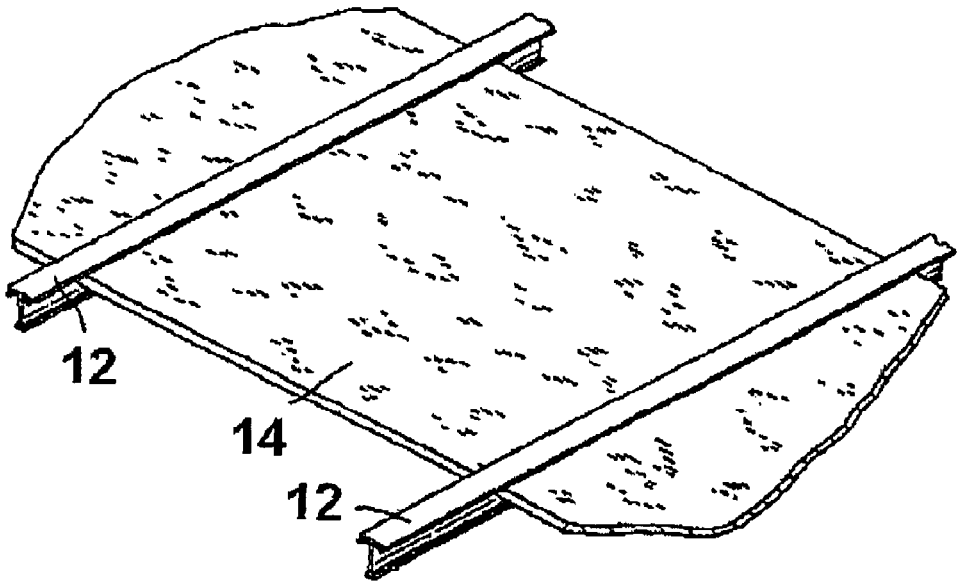
FIG. 2 is a top perspective view of a fragment of a conventional grid/ceiling panel arrangement in the ceiling structure.

As shown more clearly in FIG. 3 each panel 14 comprises a core 20 defining front and rear sides 22, 24, and front and rear layers of material 26, 28 directly adhered to and covering the front and rear sides, respectively.

By "front" layer is meant a layer which faces the sound field (e.g., a room in which the panels are located) and which is thus exposed upon being installed, whereas "rear" layer is the layer which faces the plenum 16. By "core" is meant any structure which creates generally an air space between the front and the rear layers but creates no appreciable air flow resistance, i.e., no air flow resistance greater than about 100 MKS rayls is created. The front and rear layers must be thin, i.e., substantially thinner than the thickness T of the core and must create a considerable air flow resistance. The air flow resistance of the front layer 26 is in the range of about 300 to about 800 MKS rayls, more preferably about 350 to about 750 MKS rayls. The air flow resistance of the rear layer 28 is in the range of about 300 to about 1200 MKS rayls, more preferably about 400 to about 1000 MKS rayls. Preferably, the thicknesses of each of the front and rear layers, respectively, does not exceed about 0.125 inches.

Any suitable materials may be used to form the core and the front and rear layers.

Examples of preferred core structures includes folded or pleated non-woven glass mats, porous and/or fibrous sheet materials woven or non-woven (e.g. polymer fibers and natural fibers), open cell porous materials of resilient or rigid materials such as slag, aluminum, polymer foams, or an array or skeletal frame, of rigid or resilient elements creating an air space between the front and rear layers.

By providing a layer-core-layer type of acoustic panel in which: the core creates no appreciable air flow resistance, the front layer has an air flow resistance in the range of about 300 to about 800 MKS, and the rear layer has an air flow resistance in the range of about 350 to about 750 MKS rayls, it is ensured that a noise reduction coefficient at or near optimum (i.e., at or near 1.0 NRC) will be achieved. On the other hand, when making a layer-core-layer acoustic panel while following the afore-described conventional criteria, i.e., designing the panel to have an overall air flow resistance within the range of 1000-2000 MKS rayls, it is possible for the resulting panel to have acoustic properties that are considerably below optimum acoustic properties unless the panel is characterized by the right combination of flow resistances. In accordance with the present acoustic panel, optimum noise reduction can be achieved even if the overall flow resistance is outside of the 1000-2000 rayls range.

It will be appreciated by those skilled in the art that additions, modifications, substitutions and deletions not specifically described may be made without departing from the spirit and scope of the invention as defined in the appended claims.

What is claimed is:

1. A lay-in ceiling structure comprising:

a structural ceiling;

a grid spaced below the structural ceiling to form an air space therebetween; and a plurality of acoustic panels supported on the grid, wherein an air space is formed between the panels and the structural ceiling, each of at least some of the panels comprising a core portion having opposite front and rear sides and front and rear layers covering the front and rear sides, respectively; the rear side facing the structural ceiling; wherein the air flow resistance of the core portion does not exceed about 100 MKS rayls; the air flow resistance of the front layer being in the range of about 300 to about 800 MKS rayls; and the air flow resistance of the rear layer being in the range of about 300 to about 1200 MKS rayls.

2. The ceiling structure according to claim 1 wherein the air flow resistance of the front layer is in the range of about 350 to about 750 MKS rayls, and the air flow resistance of the rear layer is in the range of about 400 to about 1000 MKS rayls.

3. The ceiling structure according to claim 1 wherein the core portion comprises a nonwoven fiberglass mat.

4. The ceiling structure according to claim 3 wherein the mat comprises a folded-up strip of non-woven fiberglass.

5. The ceiling structure according to claim 1 wherein each of the front and rear layers has a thickness no greater than about 0.125 inches.

6. The ceiling structure according to claim 1 wherein the air space is about 16 inches high.

7. The ceiling structure according to claim 1 wherein the front layer is adhered directly to the front side of the core portion and the rear layer is adhered directly to the rear side of the core portion.

8. An acoustic ceiling panel comprising a core portion having front and rear sides and front and rear layers disposed on the front and rear sides, respectively; wherein the air flow resistance of the core portion does not exceed about 100 MKS rayls, the air flow resistance of the front layer is in the range of about 300 to about 800 MKS rayls; and the air flow resistance of the rear layer is in the range of about 300 to about 1200 MKS rayls.

9. The ceiling panel according to claim 8 wherein the air flow resistance of the front layer is in the range of about 350 to about 750 MKS rayls, and the air flow resistance of the rear layer is in the range of about 400 to about 1000 MKS rayls.

10. The ceiling panel according to claim 8 wherein the core portion comprises a nonwoven fiberglass mat.

11. The ceiling panel according to claim 10 wherein the mat comprises a folded strip of non-woven fiberglass.

12. The ceiling panel according to claim 8 wherein each of the front and rear layers has a thickness no greater than about 0.125 inches.

13. The ceiling panel according to claim 8 wherein the front and rear layers are adhered directly to the front and rear sides respectively, of the core portion.

* * * * *